US009117571B2

(12) United States Patent
Ulfig et al.

(10) Patent No.: US 9,117,571 B2
(45) Date of Patent: Aug. 25, 2015

(54) ELECTRICAL LINES

(75) Inventors: Peter Ulfig, Mehren (DE); Walter Winkelbauer, Duisburg (DE); Christian Cornelissen, Rodgau (DE)

(73) Assignee: NEXANS, Paris (FR)

( * ) Notice: Subject to any disclaimer, the term of this patent is extended or adjusted under 35 U.S.C. 154(b) by 351 days.

(21) Appl. No.: 13/440,155

(22) Filed: Apr. 5, 2012

(65) Prior Publication Data

US 2012/0261159 A1 Oct. 18, 2012

(30) Foreign Application Priority Data

Apr. 14, 2011 (EP) ..... 11305435

(51) Int. Cl.

| | |
|---|---|
| ***H01B 11/04*** | (2006.01) |
| ***H01B 11/10*** | (2006.01) |
| *H01B 7/04* | (2006.01) |
| *H01B 9/00* | (2006.01) |

(52) U.S. Cl.

CPC ..... *H01B 11/10* (2013.01); *H01B 7/041* (2013.01); *H01B 9/003* (2013.01)

(58) Field of Classification Search

CPC ..... H01B 11/04; H01B 11/06; H01B 3/38
USPC ..... 174/113 R, 110 R
See application file for complete search history.

(56) References Cited

U.S. PATENT DOCUMENTS

| | | | | |
|---|---|---|---|---|
| 4,096,346 | A * | 6/1978 | Stine et al. | 174/36 |
| 4,154,892 | A * | 5/1979 | Glatti et al. | 428/372 |
| 4,538,022 | A * | 8/1985 | Barnicol-Ottler et al. | 174/113 R |
| 5,804,762 | A * | 9/1998 | Jones et al. | 174/358 |
| 5,916,940 | A * | 6/1999 | Hirai et al. | 524/301 |
| 2002/0117325 | A1 * | 8/2002 | Mennone et al. | 174/121 A |
| 2007/0068696 | A1 * | 3/2007 | Matsui et al. | 174/113 R |
| 2009/0238957 | A1 * | 9/2009 | Clancy | 427/117 |
| 2010/0000759 | A1 * | 1/2010 | Lumachi et al. | 174/107 |
| 2010/0300725 | A1 * | 12/2010 | Nakayama et al. | 174/110 SR |

FOREIGN PATENT DOCUMENTS

| | | | |
|---|---|---|---|
| EP | 1134749 | | 9/2001 |
| GB | 2442298 | * | 4/2008 |

* cited by examiner

*Primary Examiner* — Chau N Nguyen
(74) *Attorney, Agent, or Firm* — Sofer & Haroun, LLP

(57) ABSTRACT

An electrical line with at least two leads composed of conductors surrounded by insulation (4) is proposed, where the leads are stranded together and are surrounded by a common electrical shield above which is mounted a circumferential layer of insulation material. The insulation (4) of the leads is composed of a poorly compressible, cross-linked elastomer insulation material whose insulation resistance constant at room temperature is greater than 4,000MΩkm. The shield (7) is composed of a non-woven fabric on the basis of polyamide which. is rendered electrically conductive through metallization.

6 Claims, 1 Drawing Sheet

ELECTRICAL LINES

RELATED APPLICATION

This application claims the benefit of priority from European Patent Application No. 11 305 435.7, filed on Apr. 14, 2011, the entirety of which is incorporated by reference.

BACKGROUND

1. Field of the Invention

The invention relates to an electrical line with at least two leads composed of conductors surrounded by an insulation, wherein the leads are stranded together and surrounded by a common electrical shield, above which a layer of insulation material is mounted circumferentially (EP 1 134 749 A1).

2. Description of the Related Art

Lines of this type are used, for example, for transmitting signals of information technology. Important for such lines is an electrically effective shield which maintains its function unchanged even after frequent bending of the line. Also significant are the dimensions of the lines which should be as small as possible, for example, when such a line is to be arranged in the core of a high voltage cable or of a high voltage line for serving as an additional element for control purposes.

The above mentioned line according to EP 1 134 749 A1 has two leads which have an insulation consisting, for example, of polyethylene (PE) or polypropylene (PP). The two leads are surrounded by an inner casing composed of a compressible insulation material. An electrical shield constructed as a woven fabric formed, for example, of copper wires is mounted over the inner casing, wherein the shield is surrounded by a protective layer formed by two wound-up films of insulation material. The insulating properties of the insulation material of the leads are not very high, so that the wall thickness of the insulation surrounding the conductor must be made relatively thick. In addition, the materials PE and PP are not suitable if they melt when a rubber casing is applied, if such a line is arranged in an appropriate high voltage cable or a high voltage line. The outer diameter of the line is correspondingly large. In addition, the wires of the woven fabric used for the shield can break easily after the line has been bent several times, so that the electrical shielding of the line has at least been impaired.

OBJECTS AND SUMMARY

The invention is based on the object of constructing the above-described line in such a way that it is permanently electrically effectively shielded with a reduced outer diameter.

In accordance with the invention, this object is met in that

- the insulation of the leads is composed of a poorly compressible, cross-linked elastomer insulation material whose insulation resistance constant at room temperature is greater than 4,000 MΩkm, and
- the shield is composed of a non-woven fabric on the basis of polyamide made electrically conductive by metallization.

The poorly compressive insulation material of the leads has a high insulation value defined through its insulation resistance constant, so that the wall thickness of the insulation of the leads can be reduced as compared to leads with conventional insulation materials, with the insulation properties remaining the same. For example, respective cross-linked elastomer insulation materials have the quality 3G13 according to DIN VDE 0207, Part 20. Accordingly, the diameter of an enveloping curve around such insulated leads which are stranded together and, thus, the outer diameter of a corresponding line can be in total reduced as compared to lines with conventional insulated leads. The shield, consisting of a metallized non-woven fabric, constitutes an almost gapless sheathing which surrounds the line completely, which, on the one hand, is flexible because of the structure of the non-woven fabric and, on the other hand, is mechanically very stable because of the material used, i.e., polyamide. This shield maintains its shielding effect even after the line has been frequently bent, because it does not contain any elements which could break.

Advantageously, the poorly compressible insulation. material additionally has a pressure resistance under heat of less than 20%, if the material is tested according to IEC 60811-3-1 at 150° C. with a test period of 1 hour (k=0.6). The value of the pressure resistance under heat is preferably less than 10%.

Copper, advantageously used for the metallization of the non-woven fabric composed of polyamide, is precipitated out of the vapor phase onto the non-woven fabric and also penetrates into the fabric.

BRIEF DESCRIPTION OF THE DRAWINGS

Embodiments of the subject matter of the invention are illustrated in the drawings.

In the drawing.

DETAILED DESCRIPTION

Figure 1:
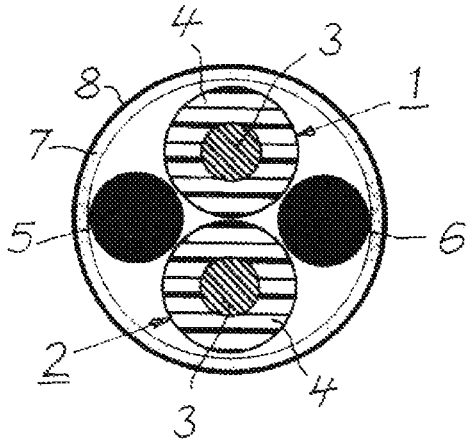
FIGS. 1 and 2 show sectional views of two lines of different construction according to the invention.

The line according to FIG. 1 has two electrical leads 1 and 2 which are stranded together. Each of the two leads 1 and 2 has an electrical conductor 3, preferably consisting of copper, and an insulation 4 surrounding the conductor 3. A cross-linked elastomer insulation material is used as an insulation material for the insulation 4 of the two leads 1 and 2, wherein the insulation resistance constant at room temperature is greater than 4,000 MΩkm. An insulation material of this type has, for example, the quality 3G13 according to DIN VDE 0207, Part 20. The insulation material is additionally very poorly compressible. For example, this is shown by a test for compressible strength under heat in accordance with IEC 60811-3-1 in which it has at 150° C. (1 h testing time, k=0.6) a value of less than 20%, preferably less than 10%. Poor compressibility and high insulation value have the effect that, by comparison to conventional insulations, significantly smaller wall thicknesses can be achieved for the same insulation.

The insulation resistance constant of the insulation material used for the insulations 4 is at ambient temperature of 90° C. greater than 15 MΩkm and preferably greater than 20MΩkm.

The conductors 3 of the leads 1 and 2 are advantageously composed of copper. They may additionally also be tin plated. Their diameter may advantageously be 1.0 mm. The wall thickness of the insulations 4 surrounding the conductors 3 may be 0.5 mm, resulting in an outer diameter of the leads 1 and 2 of 2.0 mm.

In accordance with the illustrated embodiment, two filler elements 5 and 6, which are stranded together with the leads 1 and 2, are arranged in the spaces between the leads 1 and 2. The filler elements 5 and 6 may have any chosen configuration. They are advantageously of insulation material. An electrical shield 7 is arranged above the stranded units formed of the leads 1 and 2 and the filler elements 5 and 6, wherein the shield 7 is surrounded by a layer 8 of insulation. material. The electrical line according to FIG. 1 manufactured in this manner advantageously has an outer diameter of 4.6 mm.

The shield 7, which is circumferentially closed and is present over the entire length of the line is composed of a metallized and, thus, electrically conductive non-woven fabric on the basis of polyamide. Copper is advantageously used for the metallization, wherein the copper is precipitated out of the vapor phase on the non-woven fabric. The copper also penetrates into the fabric, so that an electrically conductive layer is formed which is relatively thick and which is almost closed with the exception of pores.

A spunbond fabric of polyethylene terephthalate (PETP) is used advantageously for the layer 8 surrounding the shield 7, wherein the spunbond fabric is wound in the form of a band around the shield 7 without a gap or may also be integrally formed with longitudinally entering material. Instead of the spunbond fabric, or as an addition, a casing of conventional insulating material can be mounted above the shield 7.

Figure 2:
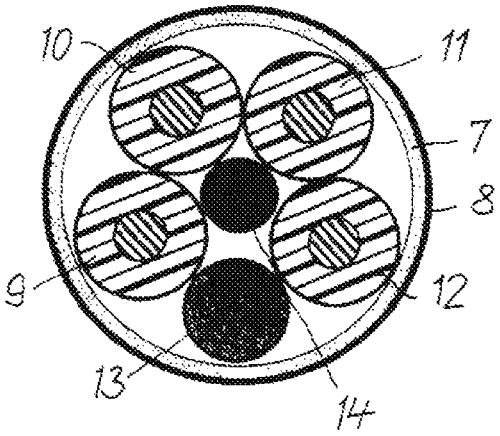

The line according to FIG. 2 has four leads 9, 10, 11 and 12 which are constructed in the same manner as the leads 1 and 2. However, they may also have different dimensions than the leads 1 and 2. In addition to the four leads, a blank metal conductor 13 is present in the line against which the shield 7 rests tightly. The shield 7 serves essentially for improved contact ability when electrical contact elements are connected to the shield, for example, by crimping. The five elements 9 to 13 are stranded together. They are advantageously stranded around a central core element 14 of insulation material. The core element 14 is preferably of PETP yarn.

Figure 3:
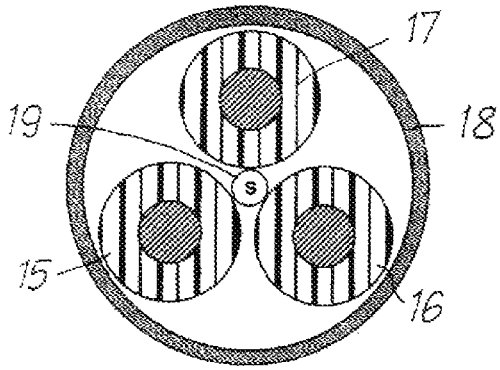
FIG. 3 shows a sectional view of an electrical cable containing a line according to the invention.

The outer diameter of the line according to FIG. 1 or 2 is so small that an appropriate line can be integrated without problems in a high voltage cable. Such a high voltage cable is schematically illustrated in a sectional view in FIG. 3. It has three phase leads 15, 16 and 17 which are stranded together and are of conventional construction and are surrounded by a common casing 18 of insulation material. The line according to the invention has dimensions which are so small that, in the illustrated embodiment, it can be arranged in the inner piece between the three phase leads 15, 16 and 17. It is designated 19 in FIG. 3. The line 19 could, however, also be arranged at a different location in the high voltage cable according to FIG. 3.

The invention claimed is:

1. Electrical line comprising:

at least two conductors surrounded by an insulation, wherein the conductors are stranded together and are surrounded by a common electrical shield, which is surrounded by a circumferentially extending layer of insulation material, wherein the insulation of the conductors is composed of a poorly compressible, cross-linked elastomer insulation material, which has pressure resistance under heat of less than 20% in accordance with a test pursuant to IEC 60811-3-1 at 150° C. and a testing period of one hour (k=0.6), wherein the insulation resistance constant of the cross-linked elastomer insulation material at room temperature is greater than 4,000 MΩkm, and the shield is composed of a completed non-woven fabric on the basis of polyamide which is rendered electrically conductive through metallization by precipitation of copper out of the vapor phase, the copper thereby penetrating into the fabric.

2. Line according to claim 1, wherein the value of the pressure resistance under heat is less than 10%.

3. Line according to claim 1, wherein the insulation resistance constant of the cross-linked elastomer insulation material is greater than 15 MΩkm at an ambient temperature of 90° C.

4. Line according to claim 1, wherein the insulation resistance constant of the cross-linked elastomer insulation [of the leads] material is greater than 20 MΩkm at an ambient temperature of 90° C.

5. Line according to claim 1, wherein the conductors are stranded together with a blank metal conductor against which the shield rests tightly.

6. Line according to claim 1, wherein the conductors are stranded around a central core element of insulation material.

* * * * *